US005823348A

United States Patent [19]

Phillips et al.

[11] Patent Number: 5,823,348

[45] Date of Patent: Oct. 20, 1998

[54] SUSPENSION PACKAGE

[75] Inventors: Noel M. Phillips; Tammy L. Stiles; Jennifer R. Harding; Lewis C. Lofgren, all of Chicago, Ill.

[73] Assignee: ADE, Inc., Chicago, Ill.

[21] Appl. No.: 859,535

[22] Filed: May 20, 1997

[51] Int. Cl.[6] ..... B65D 81/10

[52] U.S. Cl. ..... 206/583; 206/594

[58] Field of Search ..... 206/583, 521, 206/594

[56] References Cited

U.S. PATENT DOCUMENTS

| | | | |
|---|---|---|---|
| 3,752,301 | 8/1973 | Bluemel . | |
| 3,853,220 | 12/1974 | Luray | 206/583 X |
| 4,013,170 | 3/1977 | Hutterer | 206/583 X |
| 4,606,459 | 8/1986 | Luray | 206/583 |
| 4,606,460 | 8/1986 | Luray . | |
| 5,056,665 | 10/1991 | Boecker et al. | 206/583 |
| 5,218,510 | 6/1993 | Bradford . | |
| 5,226,542 | 7/1993 | Boecker et al. . | |
| 5,573,119 | 11/1996 | Luray . | |
| 5,579,917 | 12/1996 | Lofgren et al. . | |

*Primary Examiner*—Bryon P. Gehman

*Attorney, Agent, or Firm*—Brinks Hofer Gilson & Lione

[57] ABSTRACT

A suspension package includes a frame having first and second opposed ends. Two C-shaped product restraints are mounted to pivotable flaps at respective ends of the frame. The product restraints extend around three sides of a product being packaged, and outward rotation of the flaps shortens the effective length of the product restraints, thereby tensioning the product restraints and suspending the product in place in the frame. A simple mechanism is provided for allowing a user to adjust the effective length of the product restraints. Another suspension package applies suspension forces only to two opposed lateral sides of the product, avoiding contact with the top and bottom surfaces of the product. Tensioning flaps can be oriented to pivot along a line in a plane parallel either to the end or to the sides of the frame.

32 Claims, 4 Drawing Sheets

P
42
34
32
36
38
30
46
41
40
44
16
26
10
12
14
15
22
20
25
18
B
24

Fig. 2
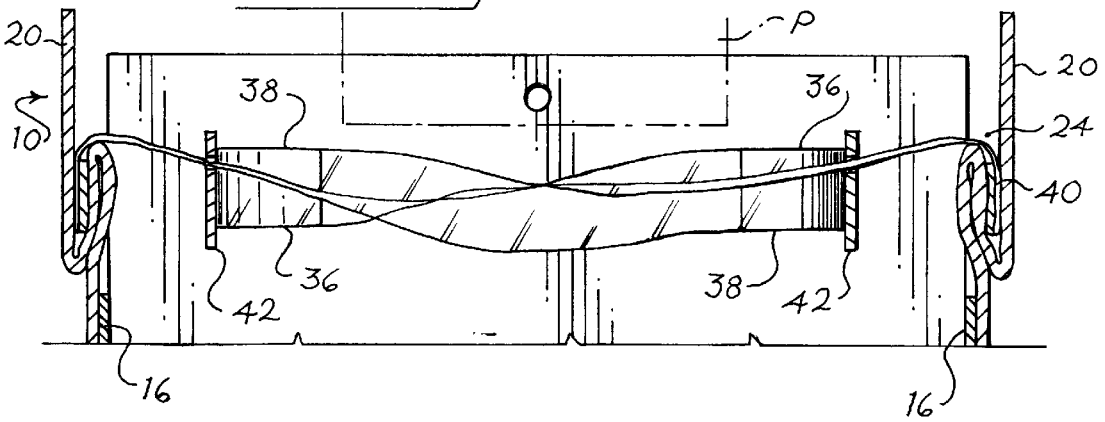
Fig. 3
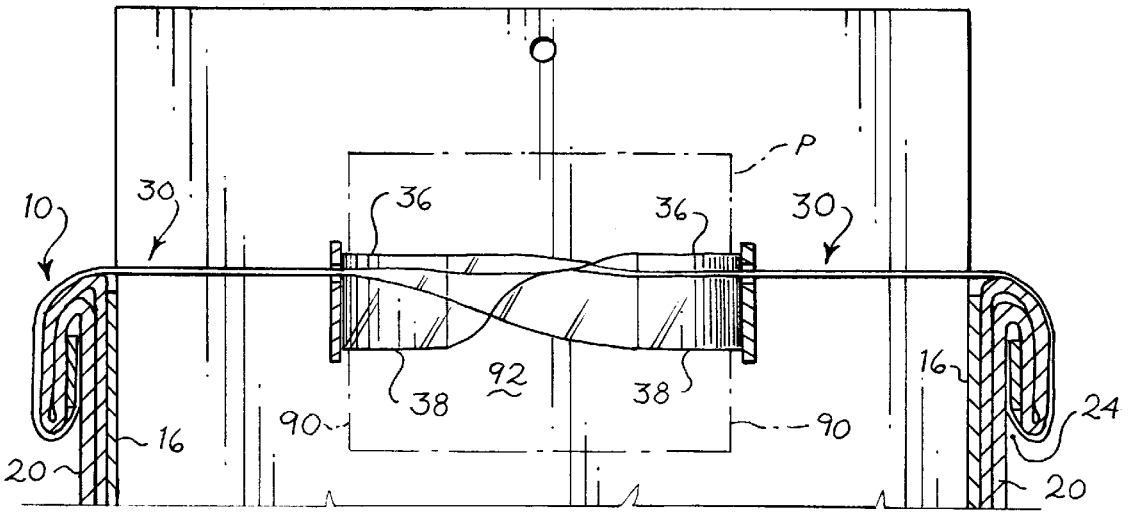
Fig. 4
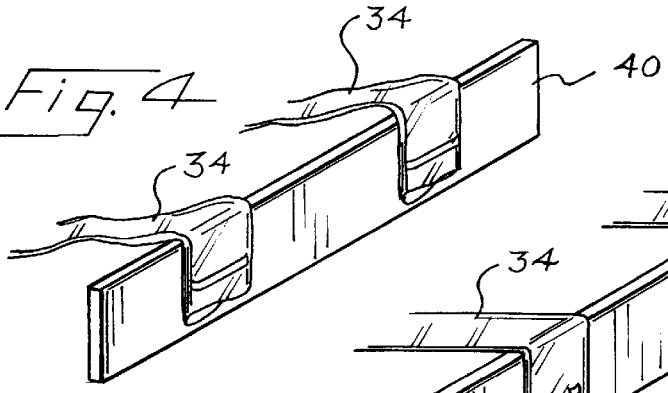
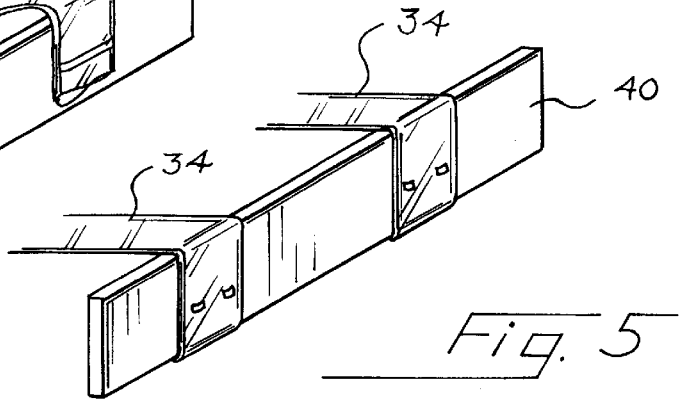
Fig. 5

SUSPENSION PACKAGE

BACKGROUND OF THE INVENTION

This invention relates to suspension packages of the type that suspend a product in place between the side walls of a frame.

U.S. Pat. Nos. 5,579,917, and 5,226,542, both assigned to the assignee of the present invention, disclose several prior-art suspension packages. In the systems described in these patents, the product being packaged is placed within a hammock that surrounds the product on all sides. When tensioning flaps on the sides of a frame are pivoted outwardly, the hammock is tensioned, and the product contained within the hammock is suspended within the frame.

This prior-art approach has been found successful in a wide variety of applications. However, there are some applications where the product being packaged is so irregular in shape, or where it includes longitudinally extending surfaces that are so delicate, that a hammock may not be the optimum arrangement for suspending the product within the frame.

SUMMARY OF THE INVENTION

The present invention is directed to an improved suspension package that uses a new arrangement for applying suspension forces to the product.

The invention itself is defined by the claims that follow this specification. Without intending in any way to limit those claims, it can be said that the present invention relates to improved product restraints that in the preferred embodiment extend around the product being packaged on three sides such that, when the effective lengths of these restraints are reduced, opposing tensions on the two opposed product restraints suspend the product, preferably without any contact with delicate longitudinally extending surfaces of the product.

Another aspect of this invention relates to an improved manner for allowing a user to adjust the effective length of a product suspension element, such as one of the product restraints described above.

BRIEF DESCRIPTION OF THE DRAWINGS

FIG. 2 is a fragmentary longitudinal sectional view of the embodiment of FIG. 1, prior to tensioning of the product restraints.

FIG. 3 is a longitudinal sectional view corresponding to the structure of FIG. 2, after the product restraints have been tensioned.

FIGS. 4 and 5 are fragmentary perspective views of portions of product restraints included in the embodiment of FIG. 1.

DETAILED DESCRIPTION OF THE PRESENTLY PREFERRED EMBODIMENTS

Figure 1:
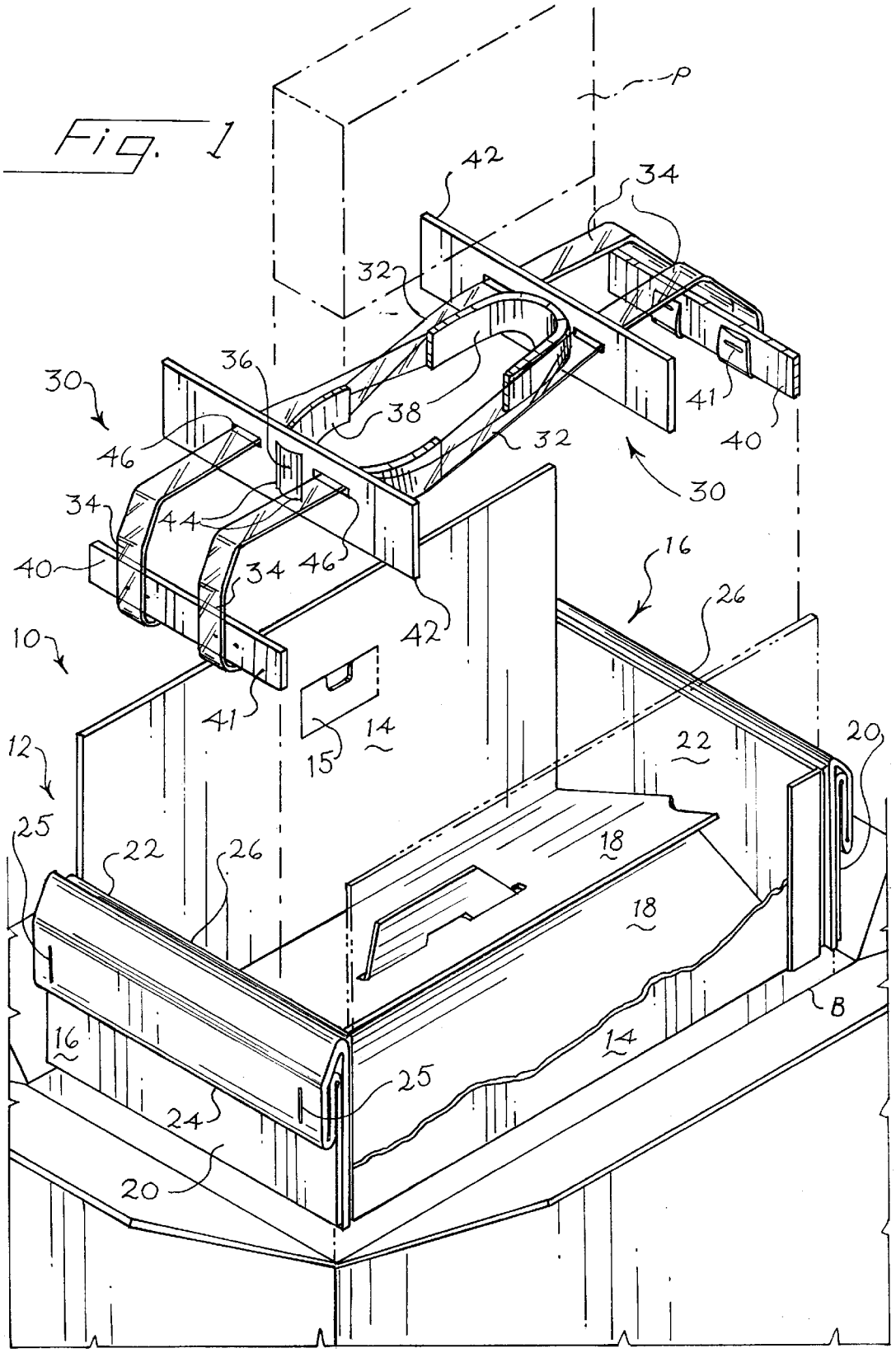
FIG. 1 is an exploded perspective view of a suspension package that incorporates a presently preferred embodiment of this invention.

Turning now to the drawings, FIG. 1 shows an exploded perspective view of a suspension package 10 that incorporates a presently preferred embodiment of this invention.

The suspension package 10 includes a rectangular frame 12 that includes two spaced, parallel sides 14 and two spaced, parallel ends 16. In this embodiment each of the sides 14 terminates in a bottom flap 18, and the bottom flaps 18 are positioned to extend upwardly to a central region of the ends 16 in order to brace the ends 16 against collapse. In alternate embodiments the frame may or may not include a bottom, as appropriate for the particular application.

Each of the ends 16 includes a respective pivotable flap 20. In this embodiment the flap 20 is secured to the base 22 of the end 16, and the flap 20 is mounted for pivoting movement about a hinge 26 which is oriented generally perpendicularly to the sides 14. In this example the hinge 26 is a living hinge, and no additional parts are required. As shown in FIG. 1, each of the flaps 20 is folded in an S-fold to create a respective pocket 24. The S-folds are preferably secured in the configuration shown in FIG. 1, as for example by staples 25 or adhesives. As shown in FIG. 1, the flap 20 has a width slightly greater than that of the base 22 such that the flap 20 forms a stiff, bending-resistant element bridging the sides 14. In this way, the overall strength of the frame 12 is not limited by the strength of the base 22. Such a bridging element is described in detail in U.S. Pat. No. 5,579,917, assigned to the assignee of the present invention.

The embodiment of FIG. 1 also includes a pair of opposed product restraints 30. Each of the product restraints 30 includes a resilient strap 32 having two end portions 34 and an intermediate portion 36. Each of the straps 32 is generally arranged in a C-shaped configuration. An elastomeric pad 38 is secured to the intermediate or central portion 36 of each of the straps 32, and the end portions 34 of each of the straps 32 are secured to a respective mounting element 40, such as the plate shown in the drawings. For example, the end portions 34 can be secured to the mounting element 40 by means of staples 41. Alternately, the pad 38 may be adhered to the straps 32 and pass through the guides 42.

Two spaced guides 42 are provided, each adjacent a central portion of one of the elastomeric pads 38. Each of the guides 42 defines two central openings 44 and two side openings 46. The side openings 46 receive the end portions 34 of one of the straps 32, and the central openings 44 receive the intermediate portion 36 of the other of the straps 32. The intermediate portions 36 may be secured to the guides 42 or not, as desired. However, in this embodiment the end portions 34 are free to slide freely through the side openings 46. In this way, the guides 42 guide movement of the end portion 34 relative to the intermediate portion 36 while maintaining the straps 32 substantially co-planar.

The product restraints 30 are secured to the frame 12 by placing the mounting elements 40 in the pockets 24. The frame 12 is designed to be shipped inside an outer box B, which closely receives the frame 12 and holds the flaps 20 in the position shown in FIG. 1. The upper edges of the sides 14 prevent the frame 12 from undesired movement within the box B.

FIGS. 2 and 3 show the suspension package 10 in two use configurations. In FIG. 2 the flaps 20 are raised to the vertical position and the guides 42 are positioned at a relatively large spacing. In this way the intermediate portions 36 and the elastomeric pads 38 are separated from one another to the greatest possible extent. When the flaps 20 are in this position a product P can be easily inserted into a product suspension region between the elastomeric pads 38. If desired, folding hooks 15 can be formed in the sides 14. These hooks 15 can be folded inwardly and the straps 32 can be placed on the hooks 15 to facilitate product loading. The opening in the side 14 at the inwardly-folded hook can be used as a hand hold in lifting the frame 12.

Once the product P has been placed between the elastomeric pads 38, the flaps 20 can be rotated outwardly to the lower position shown in FIG. 3. As the flaps 20 are rotated outwardly, the effective length of each of the product restraints 30 is reduced, thereby causing the intermediate portions 36 and the elastomeric pads 38 to approach more closely to one another. Preferably, the straps 32 have a length such that when the flaps 20 are in the lower position of FIG. 3 the straps 32 press the elastomeric pads 38 tightly against the product P, thereby suspending the product P in space in the frame 12.

In use, each of the product restraints extends around the central region of the product suspension region on three sides. Referring to FIG. 3, the product P can be said to occupy a central region of the product suspension region, and both the product P and the central region include end faces 90 and side faces 92. The end faces 90 are interposed between the elastomeric pads 38 such that in each case the product P is interposed between the elastomeric pad 38 and the end 16 to which the respective product restraint 30 is mounted. As the flaps 20 are moved outwardly, the elastomeric pads 38 and the intermediate portions 36 are moved toward one another along an axis extending between the ends 16. When the flaps 20 are positioned as shown in FIG. 3, opposing tensions on the product restraints 30 pull each end face 90 toward the center of the frame 12, thereby suspending the product P in place.

It should be apparent that the flaps 20 operate as a means for shortening the effective length of the product restraints 30. As used herein "effective length" means the length of the product restraint that extends past the respective end 16 into the product suspension region. Many alternatives are possible to the illustrated flaps. For example, if desired a flap 20 can be provided on only one end 16 of the frame 12. Also, the flaps 20 can take any desired form, and may be injection molded or formed of other materials in alternative embodiments.

The product restraints 30 are removably mounted in the flaps 20 to allow a user to adjust their overall length. As shown in FIG. 4, in one position the end portions 34 extend away from the mounting elements 40 without wrapping around the mounting elements 40. When the mounting elements 40 are placed in the pockets 24 in this position, the product restraints 30 have a relatively long length. As shown in FIG. 5, the end portions 34 may be wrapped one or more times around the mounting elements 40 before the mounting elements 40 are placed within the pockets 24 (FIGS. 2 and 3). When this is done, the overall length of the product restraints is reduced. In this way the length of the product restraints, and thereby the tension on the product restraints when the flaps are in the position of FIG. 3, can readily be adjusted to adapt the suspension package 10 to a particular product P. If desired, the mounting elements may include two panels folded to a V-shape, with the end portions 34 inserted between the panels, and with staples securing the panels and the end portion together.

Figures 6, 7, 9:
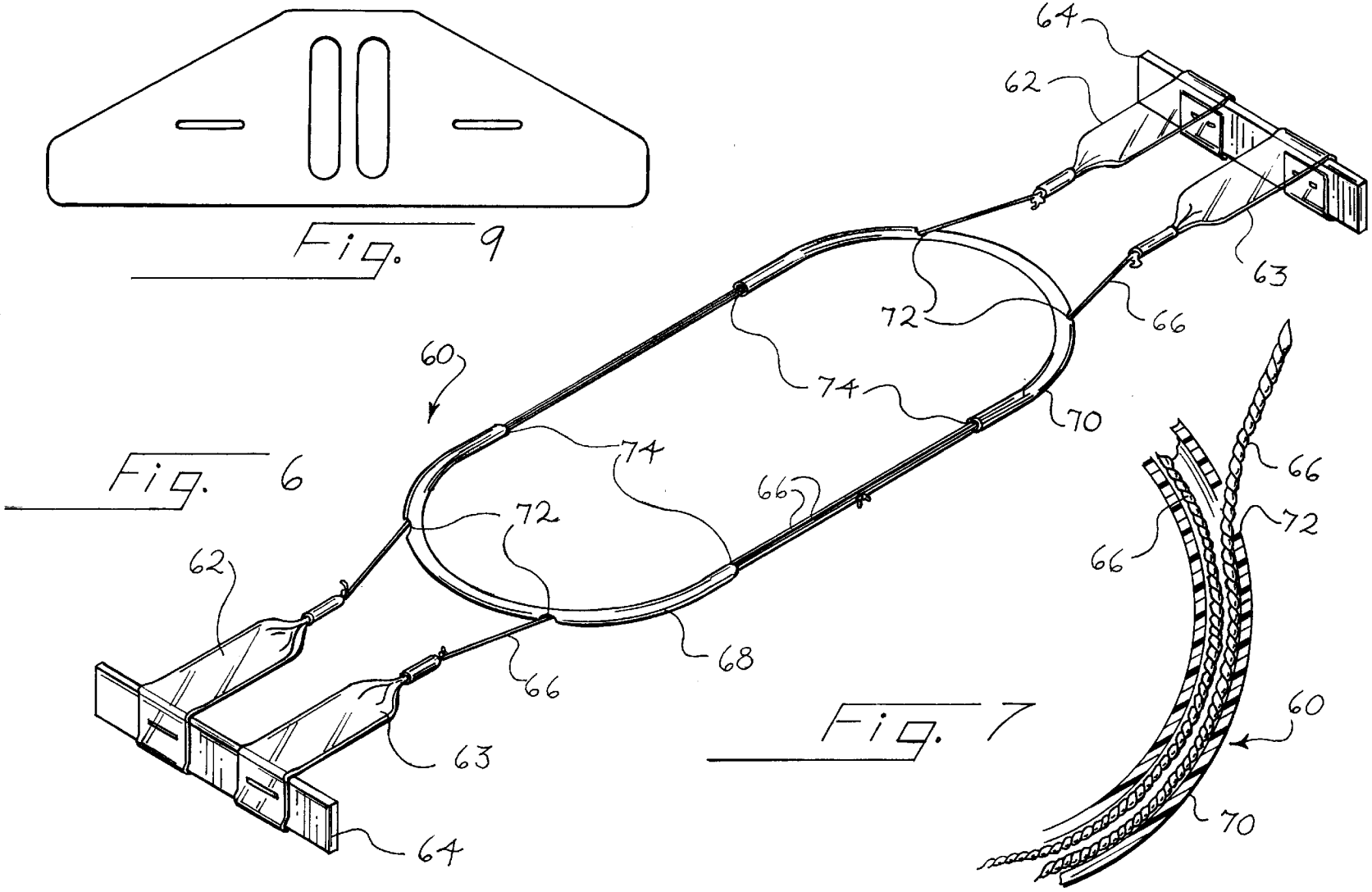
FIG. 6 is a perspective view of an alternate set of product restraints.
FIG. 7 is a fragmentary sectional view showing a portion of the structure of FIG. 6.
FIG. 9 is a plan view of a guide suitable for use in the embodiment of FIG. 1.

FIGS. 6 and 7 relate to a second product restraint 60 that can be used in the frame 12. The product restraint 60 includes a pair of resilient straps 62, 63 that are secured to a mounting element 64, as described above. In this embodiment each of the straps 62, 63 is secured to a respective end of a cord 66. The cords 66 are each arranged in a C-shape configuration, and each of the cords 66 is mounted to pass within at least a portion of a pair of tubes 68, 70. Each of the tubes 68, 70 defines a pair of central openings 72 and a pair of end openings 74. Each of the cords 66 passes through the central openings 72 of one of the tubes 68, 70 and then passes in a C-shape through the end openings 74 of the other tube 70, 68. The tubes 68, 70 act as guides, allowing sliding motion between the cords 66 while preventing any substantial separation in the region of the tubes between the openings 72, 74. The tubes 68, 70 also provide a high friction, low abrasion surface for contacting a product being packaged.

Simply by way of example, it has been found that corrugated paperboard can be used for the frame 12, the flap 20 and the box B. The straps 32 can be formed of a resilient plastic resin such as polyester polyurethane. The elastomeric pads 38 can be formed of a sponge rubber, and the density of the foam can be selected to provide the desired application of force to the product P. Preferably, the material selected for the elastomeric pads 38 provides good friction, long-lasting resilience, and a gentle grip. In this embodiment, the straps 32 are folded in the region of the mounting elements 40, and they are turned from the horizontal plane to the vertical plane centrally of the guides 42. The guides 42 may be die-cut from any suitable material including plastic sheet material and tubular material, for example, and preferably have a length (measured between the sides 14) adequate to provide a stop against the sides 14. The guides 42 can act as bumpers and can be scored near the ends to provide programmed collapse. Preferably, the guides 42 do not extend across the full width of the ends 16, and they allow some play. The guide 42 may be formed in one piece with the pad 58, which may secure to cords included in the product restraint. The guides 42 do not have to extend transversely, and they may be formed as rings on one restraint through which the outer restraint passes.

Figure 8:
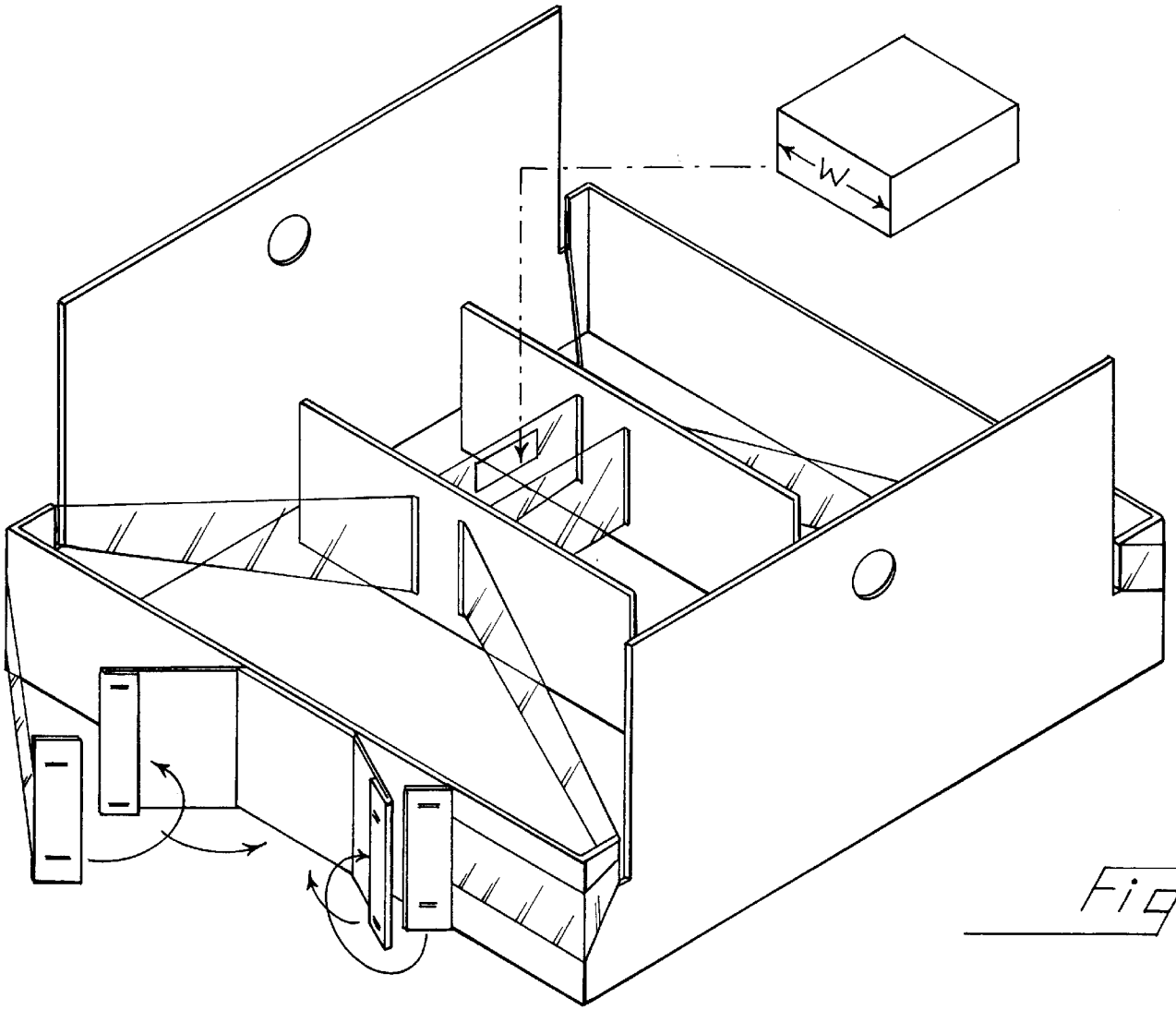
FIG. 8 is a schematic perspective view of a suspension package that incorporates another embodiment of the present invention.

Turning now to FIG. 8, this drawing shows a schematic perspective view of a suspension package 100 which incorporates another embodiment of this invention. The suspension package 100 includes a frame 102 that in turn includes two opposed ends 104 separated by two parallel sides 106. The frame 102 defines a product suspension region 108 in a central location between the ends 104 and the sides 106. A pair of product restraints 110 are provided, each comprising two end portions 112 and a central portion 118. The two end portions 112 of each product restraint 110 pass through slots 114 at respective ends of the side 106, and terminate in respective mounting elements 116. Thus, the product restraints 110 extend from one end 104 to the other of the frame 102. Each of the product restraints 110 includes a central portion 118 in the product suspension region 108, and each central 118 supports a pad 120. The pad 120 is shown schematically in FIG. 8, but in practice it can take any suitable form. For example, each pad 120 can take the form of a length of resilient foam tubing secured around the central portion 118. A pair of cross-elements 122 are provided. Each cross element 122 includes two parallel slots 124 through which the central portions 118 of the product restraints 110 pass. The slots 124 are separated by a distance D measured in a lateral direction (i.e. a plane extending between the sides 106). In this embodiment the cross elements 122 are freely slidable along the product restraints 110.

As shown in FIG. 8 each of the ends 104 supports two flaps 126 that are mounted for pivoting movement around respective hinge lines 130. Each of the flaps 126 includes a pocket 128 sized to receive the respective mounting element 116. The flaps 126 at each end 104 are arranged to fold inwardly, toward the center of the end 104. When the flaps 106 are in the outwardly rotated position as shown in FIG. 8, the product restraints 110 have a relatively longer effective length. The effective length of the product restraints 110 can be shortened by pivoting the flaps 106 inwardly. The flaps 106 are held in their inwardly rotated position by an external box (not shown in FIG. 8) which may be similar to the box B shown in FIG. 1 above. As shown in FIG. 8 the suspension package 100 can be used to package a product P having opposed lateral sides S, a top T and a bottom B. The distance between the opposed lateral sides S is indicated by the reference symbol W. Preferably, a locking bottom (not shown) is used in the frame 102, similar to that shown in FIG. 1.

In use, the mounting elements 116 are positioned in the pockets 128, and the flaps 126 are rotated outwardly as shown in FIG. 8. Then the cross elements 122 are separated from one another and the product P is placed in the product suspension region 108, between the cross elements 122, and between the pads 120. Then the flaps 126 are folded inwardly, thereby shortening the effective lengths of the product restraints 110, and pressing the pads 120 against opposed lateral sides S of the product P. In order to ensure adequate suspension forces, the selected distance D is chose to be less than the width W, thereby ensuring that suspension forces are applied to the opposed lateral sides S of the product P. Preferably, the end portions 122 at each end 104 are separated by a distance greater than the distance D in order to improve stability of the product P in the frame 102. In this embodiment, the product restraints 110 and the pads 120 avoid contact with the top T or the bottom B of the product P.

Of course, many alternatives are possible. For example, the product restraints 110 can be mounted to a more conventional flap, such as the flap 20 of FIG. 1 having a hinge line in the plane of the ends 20 rather than parallel to the plane of the sides 106 as shown in FIG. 8. Furthermore, it may be preferable to use a single flap 126 at each end 104. In fact, any of the means for adjusting the effective length of the product restraint described in this specification can be used in the embodiment of FIG. 8.

Furthermore, the product restraints 110 can take any of the forms described in this specification, and the cross elements 122 can take many other forms. For example, the cross elements 122 do not necessarily slide along the product restraints 110, and they do not necessarily include end portions that extend closely adjacent to the sides 106. The pads 120 can take any suitable form, and they can be eliminated in some embodiments.

Additionally, the flaps 126 are not limited to use with product restraints 110 of the type shown in FIG. 8. Rather, the flaps 126 pivoting about hinge lines parallel to the plane of the sides 106 can be used to adjust the effective length of any product suspension element, including the product suspension element shown in FIG. 1 and conventional hammocks.

The following exemplary materials and dimensions are provided only to illustrate one preferred form of the invention. The frame 12 can be formed of 275 lb C-flute liner board, and the flaps 20 can be glued in place on the base 22. The straps 32 can be formed of 8 mil. polyester polyurethane having a width of two inches. The guides 42 can be formed of plastic corrugated material, and can be shaped as shown in FIG. 9.

The means for adjusting the effective length of the product restraints can take other forms. For example, toggles or other length-adjusting elements can be placed directly in the product restraints 30, thereby eliminating the need for a hinged flap in some embodiments. Other means for adjusting effective length include various systems that allow a user to tighten the restraint and then to secure it in place, as for example a notch cooperating with knots on the restraint, or one or more buckles. Also, the mounting elements 40 described above can serve this purposes.

Also, many alternatives are possible for the product restraints 30, 110. For example, netting can be substituted for the cord 66 in the embodiment of FIGS. 6 and 7. Each product restraint 30 can be formed of a respective C-shaped cord which is itself elastomeric. As used herein, the term "elastomeric" is intended broadly to encompass rubber and synthetic rubber-like compounds. For example, the product restraints 30, 110 can be formed of or include bungee cords, polyurethane tubing, rubber bands, or various woven materials. Also, the product restraints 30, 110 may be formed of or include inextensible materials.

The length adjusting feature described above in conjunction with the pockets 24 and the mounting elements 40 can be used with other types of product suspension elements, including hammocks of the type described in U.S. Pat. No. 5,579,917, assigned to the assignee of the present invention.

The suspension package 10 described above provides the advantage that a product being packaged is suspended by opposing forces on the end faces of the product. The upper and lower faces of the product can be left free of contact with any packaging element. This can be particularly useful for irregularly shaped items, or for items that have upper or lower surfaces that are too fragile for contact with packaging elements. The flaps 20 allow the product restraints 30 to be tightened about the product P in a simple, one-step motion, and the outer box B holds the flaps 20 in the rotated position. If necessary, the length of the product restraints 30 can readily be adjusted by the user, simply by removing one or both of the mounting elements 40 from the respective pockets 24, winding the straps 32 around the respective mounting elements 40, and then replacing the mounting elements 40 in the pockets 24.

The foregoing detailed description has described only a few of the many forms that the present invention can take. It is intended that this detailed description be regarded as illustrative and not as limiting. It is only the following claims, including all equivalents, that are intended to define the scope of this invention.

What is claimed is:

1. A suspension package comprising:

a frame comprising first and second opposed ends, said frame forming a product suspension region intermediate the ends;

first and second opposed product restraints mounted to the first and second ends, respectively, said restraints comprising respective first and second product-engaging portions operative to engage a product and to limit movement of the product away from the respective end, with the product interposed (1) between the first product-engaging portion and the first end, and (2) between the second product-engaging portion and the second end; and first means for shortening an effective length of at least one of the restraints such that opposing tension in the first and second restraints suspends the product in the product suspension region.

2. The invention of claim 1 wherein the first means comprises a pivotable flap included in the first end, said first restraint mounted to the flap, pivotable movement of the flap operative to alter a maximum separation between the first end and the first product-engaging portion.

3. The invention of claim 2 wherein the first means further comprises a second pivotable flap included in the second end, said second restraint mounted to the second flap, pivotable movement of the second flap operative to alter a maximum separation between the second end and the second product-engaging portion.

4. The invention of claim 1 wherein the first means comprises a flap included in the first end and coupled to a first base portion of the first end at a hinge, wherein the first restraint is mounted to the flap in a mounting region spaced from the hinge.

5. The invention of claim 4 wherein the first means comprises a second flap included in the second end and coupled to a second base portion of the second end at a second hinge, wherein the second restraint is mounted to the second flap in a second mounting region spaced from the second hinge.

6. The invention of claim 1 wherein each restraint comprises two end portions and a central portion intermediate the end portions, wherein the end portions of each restraint are mounted to the respective end to extend on either side of the product, and wherein the central portion of each restraint comprises the respective product-engaging portion, each restraint forming a C-shape adapted to extend partially around and to restrain the product.

7. A suspension package comprising:

a frame comprising first and second opposed ends, said frame forming a product suspension region intermediate the ends;

first and second opposed product restraints mounted to the first and second ends, respectively, said restraints comprising respective first and second product-engaging portions operative to engage a product and to limit movement of the product away from the respective end, with the product interposed (1) between the first product-engaging portion and the first end, and (2) between the second product-engaging portion and the second end; and said first end comprising a hinge and a flap mounted for pivoting movement about the hinge;

said first restraint mounted to the flap in a mounting region spaced from the hinge such that pivoting movement of the flap in a selected direction pulls the first product-engaging portion toward the first end.

8. The invention of claim 7 wherein the flap comprises a receiving element, wherein the first restraint comprises a mounting element, and wherein the mounting element is adjustably mounted in the receiving element for user adjustment of the effective length of the first restraint.

9. The invention of claim 7 wherein the flap comprises a pocket, wherein the first restraint comprises a mounting element, wherein the mounting element is removably received in the pocket to adjust the effective length of the first restraint.

10. The invention of claim 8 or 9 wherein the mounting element comprises a plate.

11. The invention of claim 1 or 7 wherein the first and second product-engaging portions are movable relative to one another along a line extending between the first and second ends.

12. The invention of claim 1 or 7 wherein each restraint comprises:

a resilient strap; and an elastomeric pad secured to the strap in the product-engaging portion to contact the product.

13. The invention of claim 1 or 7 further comprising a guide coupled between the first and second restraints to limit maximum separation between the first and second restraints while allowing sliding motion therebetween.

14. A suspension package comprising:

a frame comprising first and second opposed ends, said frame forming a product suspension region intermediate the ends;

each said end comprising a respective hinge and a respective flap, each said flap mounted for pivoting movement about the respective hinge;

a first product restraint comprising two first end portions secured to the flap of the first end and a first intermediate portion connected between the first end portions;

a second product restraint comprising two second end portions secured to the flap of the second end and a second intermediate portion connected between the second end portions;

said product suspension region comprising a central region, said first product restraint extending partially around the central region on three sides of the central region, said second product restraint extending partially around the central region on three sides of the central region, said first intermediate portion positioned in use on an opposite side of the central region from the first end, said second intermediate portion positioned in use on an opposite side of the central region from the second end.

15. The invention of claim 14 wherein the central region comprises first and second end faces facing the first and second ends, respectively, and first and second side faces; wherein the first and second product restraints both extend along both the first and second side faces, wherein the first intermediate portion is operative to engage the second end face, and wherein the second intermediate portion is operative to engage the first end face, such that the central region is interposed between the intermediate portions.

16. The invention of claim 14 further comprising:

at least one first guide coupled between one of the first end portions and one of the second end portions to limit maximum separation while allowing sliding motion therebetween;

at least one second guide coupled between the other first end portion and the other second end portion to limit maximum separation while allowing sliding motion therebetween.

17. A suspension package comprising:

a frame comprising first and second opposed ends, said frame forming a product suspension region intermediate the ends;

said first end comprising a hinge and a flap mounted for pivoting movement about the hinge, said flap comprising a receiving element;

a product suspension element secured to the flap to extend into the product suspension region;

said product suspension element comprising a mounting element plate, said mounting element plate adjustably mounted in the receiving element for user adjustment of the effective length of the product suspension element.

18. The invention of claim 17 wherein the receiving element comprises a pocket.

19. A suspension package comprising:

a frame comprising first and second opposed ends, said frame forming a product suspension region intermediate the ends:

first and second product restraints, each product restraint extending between the ends across the product suspension region:

first and second cross elements, each cross element extending between the product restraints at an opposite end of the product suspension region, each cross element substantially holding the product restraints at a maximum lateral separation no greater than a first selected distance;

first means for shortening an effective length of at least one of the product restraints;

a product suspended in the product suspension region by pressure from the product restraints against opposed lateral sides of the product, said product having a lateral width greater than the first selected distance.

20. The invention of claim 19 further comprising first and second pads interposed between the lateral sides of the product and respective ones of the product restraints.

21. The invention of claim 19 wherein the product restraints are coupled to the opposed lateral sides of the product while substantially avoiding contact with upper and lower sides of the product.

22. The invention of claim 19 wherein the product restraints are separated by more than the first selected distance adjacent each of the ends.

23. The invention of claim 19 or 22 wherein the cross elements are slideable along the product restraints.

24. The invention of claim 19 wherein the product restraints are separated by a distance substantially no less than the first selected distance at all points between the ends.

25. The invention of claim 19 wherein the first means comprises a flap, and wherein at least one of said restraints is secured to the flap.

26. The invention of claim 25 wherein the flap pivots about a line, and wherein the line is substantially parallel to a line extending between the lateral sides of the product.

27. The invention of claim 25 wherein the flap pivots about a line, and wherein the line is substantially perpendicular to a line extending between the lateral sides of the product.

28. A suspension package comprising:

a frame comprising first and second opposed ends, said frame forming a product suspension region intermediate the ends;

said first end comprising a hinge and a flap mounted for pivoting movement about the hinge;

a product suspension element secured to the flap to extend into the product suspension region;

said frame further comprising first and second sides extending between the ends;

said hinge oriented substantially parallel to one of the sides.

29. The invention of claim 28 wherein the invention further comprises a second product suspension element, and wherein said first end further comprises a second flap mounted for pivoting movement about a second hinge and secured to a second product suspension element;

said flaps foldable about the respective hinges into an overlapping configuration.

30. A suspension package comprising:

a frame comprising first and second opposed ends, said frame forming a product suspension region intermediate the ends;

said first end comprising a hinge and a flap mounted for pivoting movement about the hinge, said flap comprising a receiving element;

a product suspension element secured to the flap to extend into the product suspension region;

a mounting element;

said product suspension element wrapped around the mounting element, said mounting element adjustably mounted in the receiving element for user adjustment of the effective length of the product suspension element.

31. The invention of claim 30 wherein the mounting element comprises a plate.

32. The invention claim 31 wherein the receiving element comprises a pocket.

* * * * *